US005695250A

United States Patent [19]

Lin

[11] Patent Number: 5,695,250

[45] Date of Patent: Dec. 9, 1997

[54] CHAIR WITH SWIVEL SEAT AND BACKREST

[76] Inventor: Chen-Da Lin, P.O. Box 82-144, Taipei, Taiwan

[21] Appl. No.: 794,883

[22] Filed: Feb. 5, 1997

[51] Int. Cl.[6] ..... A47C 1/032

[52] U.S. Cl. ..... 297/353; 297/340; 482/130

[58] Field of Search ..... 297/353, 285, 297/301.1, 301.7, 340, 344.21, 344.22, 383; 482/130, 142

[56] References Cited

U.S. PATENT DOCUMENTS

| | | | |
|---|---|---|---|
| 2,568,988 | 9/1951 | Childs | 297/353 X |
| 4,822,093 | 4/1989 | Kawai et al. | 297/353 X |
| 5,110,121 | 5/1992 | Foster | 482/130 X |
| 5,336,138 | 8/1994 | Arjawat | 482/130 X |

*Primary Examiner*—Peter R. Brown
*Attorney, Agent, or Firm*—A & J

[57] ABSTRACT

A chair with a swivel seat and backrest includes a base support having an upright shaft, a seat having a bottom provided with a supporting board having to two opposite bolts, the two opposite bolts being fixedly installed on two opposite ends of an oscillating plate, the oscillating plate having a central portion pivotally connected with a tubular axle, the tubular axle being put on to the upright shaft of the base support, a backrest, a casing mounted on the upright shaft of the base support and located under the oscillating plate, the casing being provided with a vertical shaft having an upper portion fixedly engaged with the backrest and a lower end fixedly connected with a first gear, two linking rods each having an end pivotally connected a respective end of the oscillating plate, and means pivotally connected with the two linking rods and driven by the first gear.

5 Claims, 6 Drawing Sheets

CHAIR WITH SWIVEL SEAT AND BACKREST

BACKGROUND OF THE INVENTION

1. Field of the Invention

This invention is related to a chair and in particular to one with a swivel seat and backrest.

2. Description of the Prior Art

It has been found that the backrest of the conventional chair is fixed with respect to the seat thereby easily rendering aching in the user's back and lumbar. Therefore, it is an object of the present invention to provide an improved chair having a backrest which can be rotated with respect to the seat.

SUMMARY OF THE INVENTION

This invention is related to a chair with a swivel seat and backrest.

It is the primary object of the present invention to provide a chair having a backrest which can be rotated with respect to a seat.

It is another object of the present invention to provide a chair with a swivel seat and backrest which can give exercise to the user's lumbar.

It is still another object of the present invention to provide a chair with a swivel seat and backrest which can remedy the lumbar and back aching.

It is still another object of the present invention to provide a chair with a swivel seat and backrest which is simple in construction.

It is a further object of the present invention to provide a chair with a swivel seat and backrest which is fit for practical use.

The foregoing objects and summary provide only a brief introduction to the present invention. To fully appreciate these and other objects of the present invention as well as as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
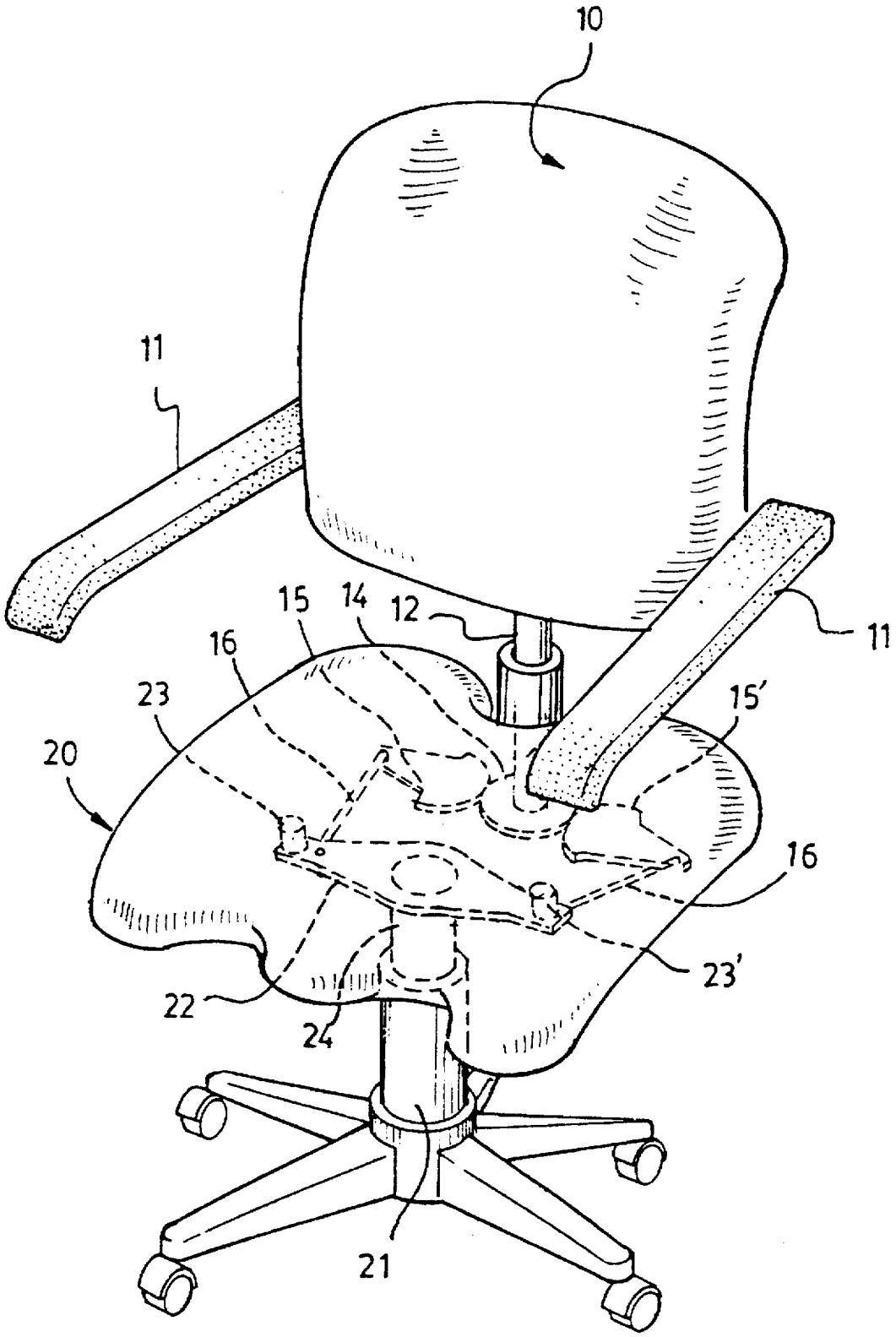
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
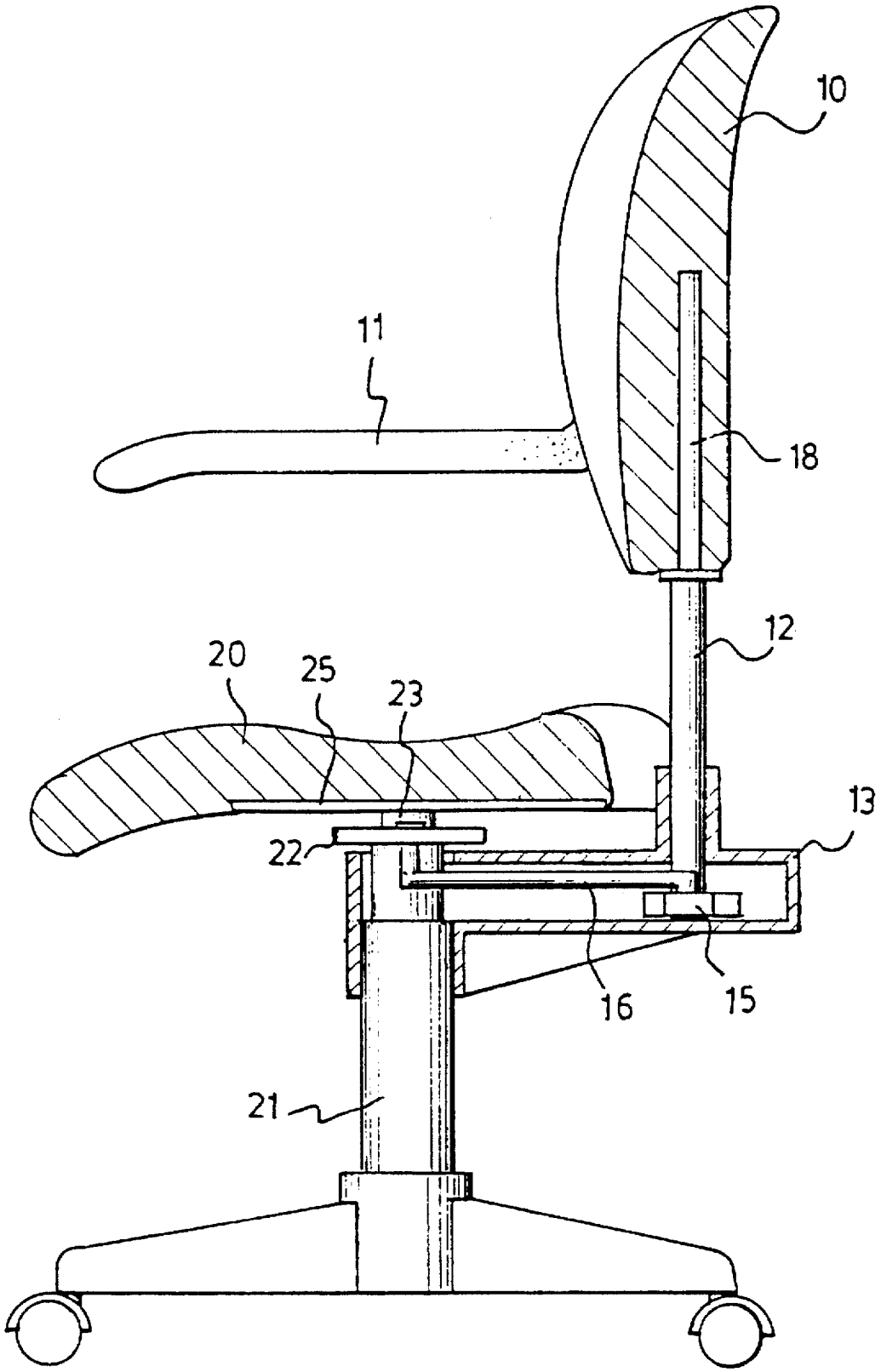
FIG. 2 is a sectional view of the present invention.

With reference to the drawings and in particular to FIGS. 1 and 2 thereof, the chair with swivel seat and backrest according to the present invention basically comprises a seat 20 and a backrest 10. The bottom of the seat 20 has a supporting board 25 provided with two opposite bolts 23. The two opposite bolts 23 are fixedly mounted on two opposite ends of an oscillating plate 22. The center of the oscillating plate 22 is pivotally connected with an tubular axle 24. The tubular axle 24 is put on to an upright shaft of a base support 21.

A casing 13 is mounted on the upright shaft of the base support 21 and located under the oscillating plate 22. The casing 13 is provided with a vertical shaft 12 the upper portion 18 of which is fixedly engaged with the backrest 10.

Figure 3:
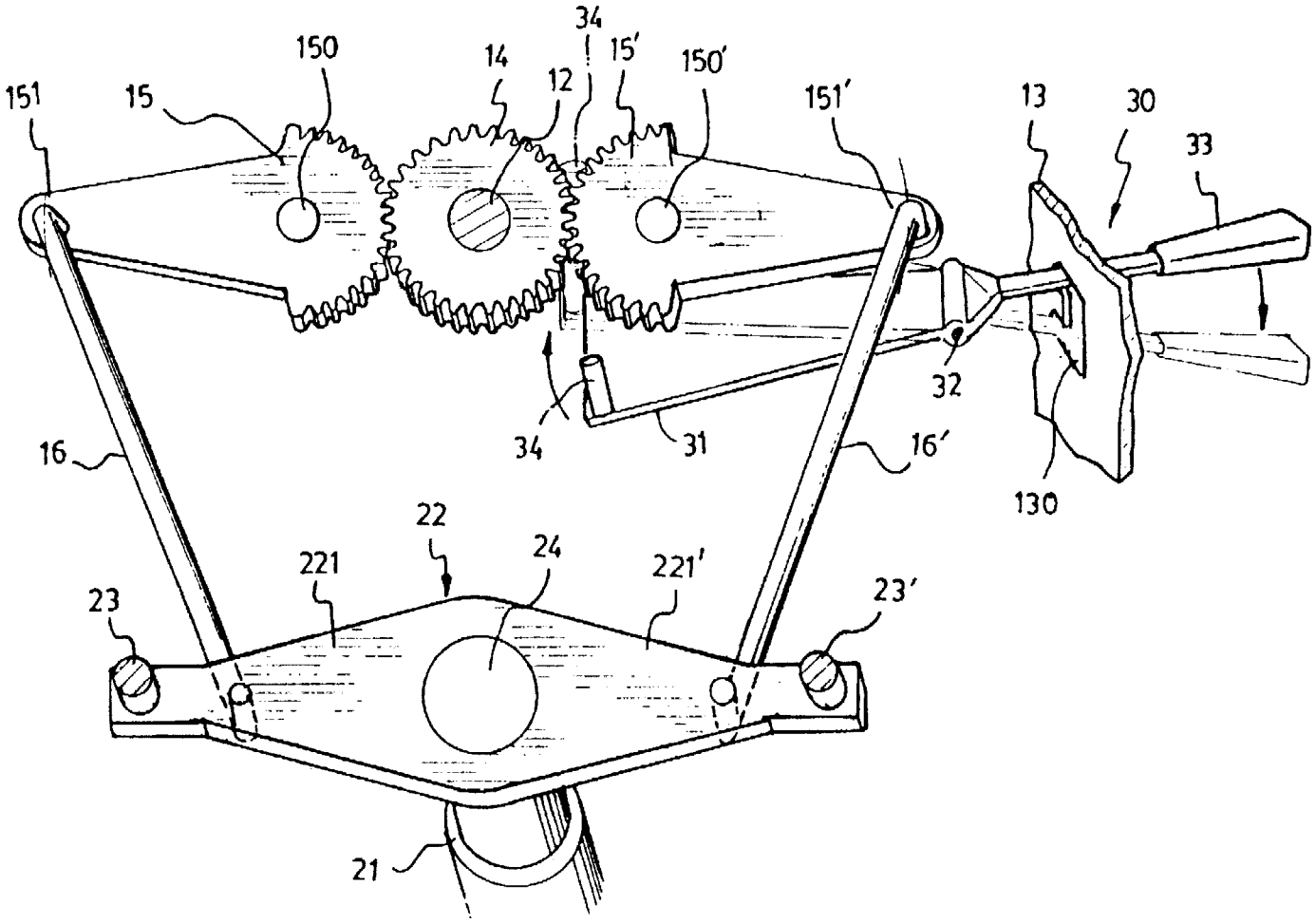
FIG. 3 illustrates the structure of the present invention.

As shown in FIGS. 2 and 3, the lower end of the vertical shaft 12 is fi+xedly connected with a gear 14 which is meshed with two toothed sectorial members 15 and 15' at two opposite sides which are pivotally mounted on two axles 150 and 150'. The outer ends 150 and 151' of the two toothed sectorial members 15 and 15' are pivotally connected with two linking rods 16 and 16' at an end. The other ends of the two toothed sectorial members 15 and 15' are pivotally connected with two ends 221 and 221' of the oscillating plate 22.

Figure 4:
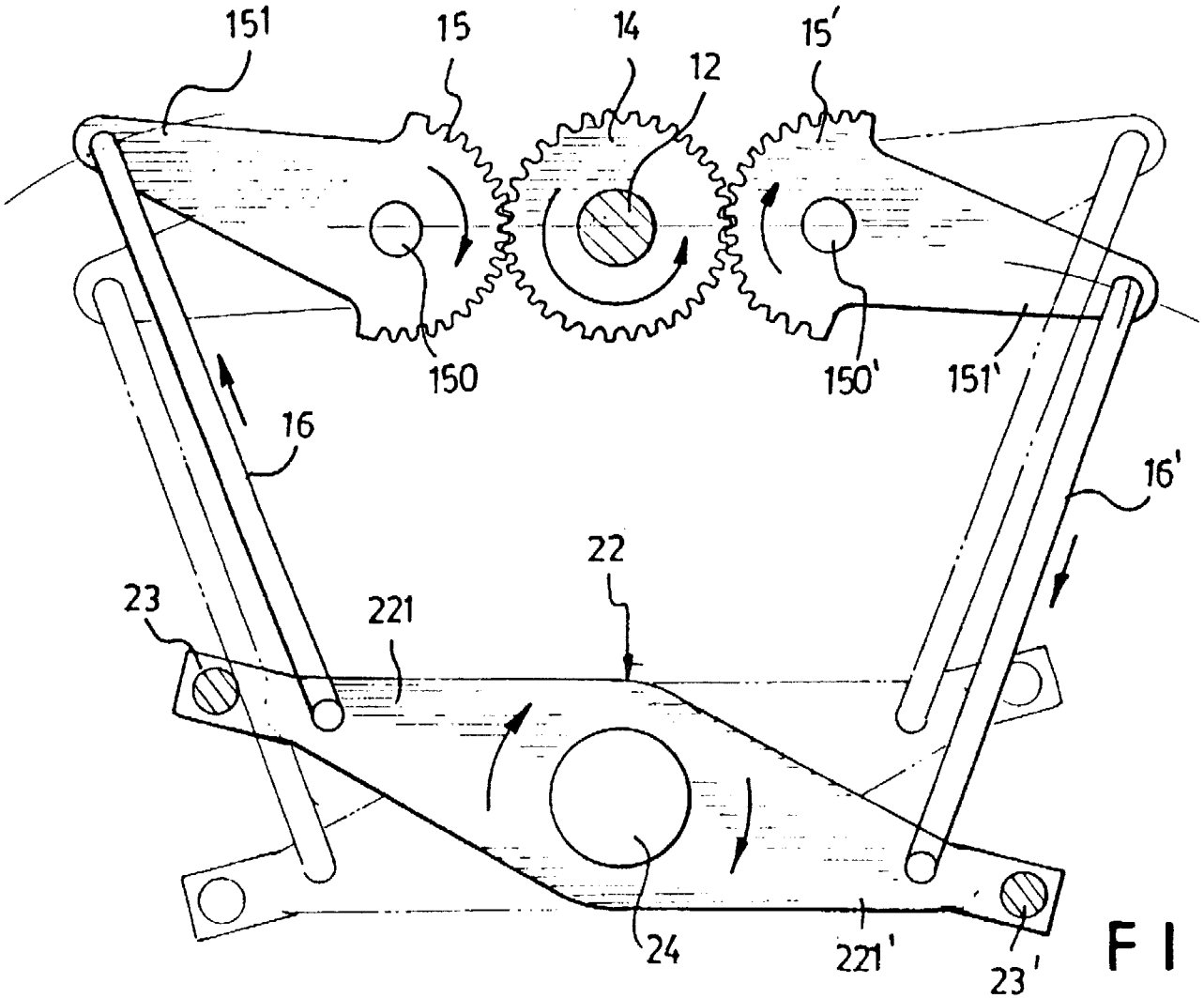
FIG. 4 illustrates how the present invention works.
Figure 6:
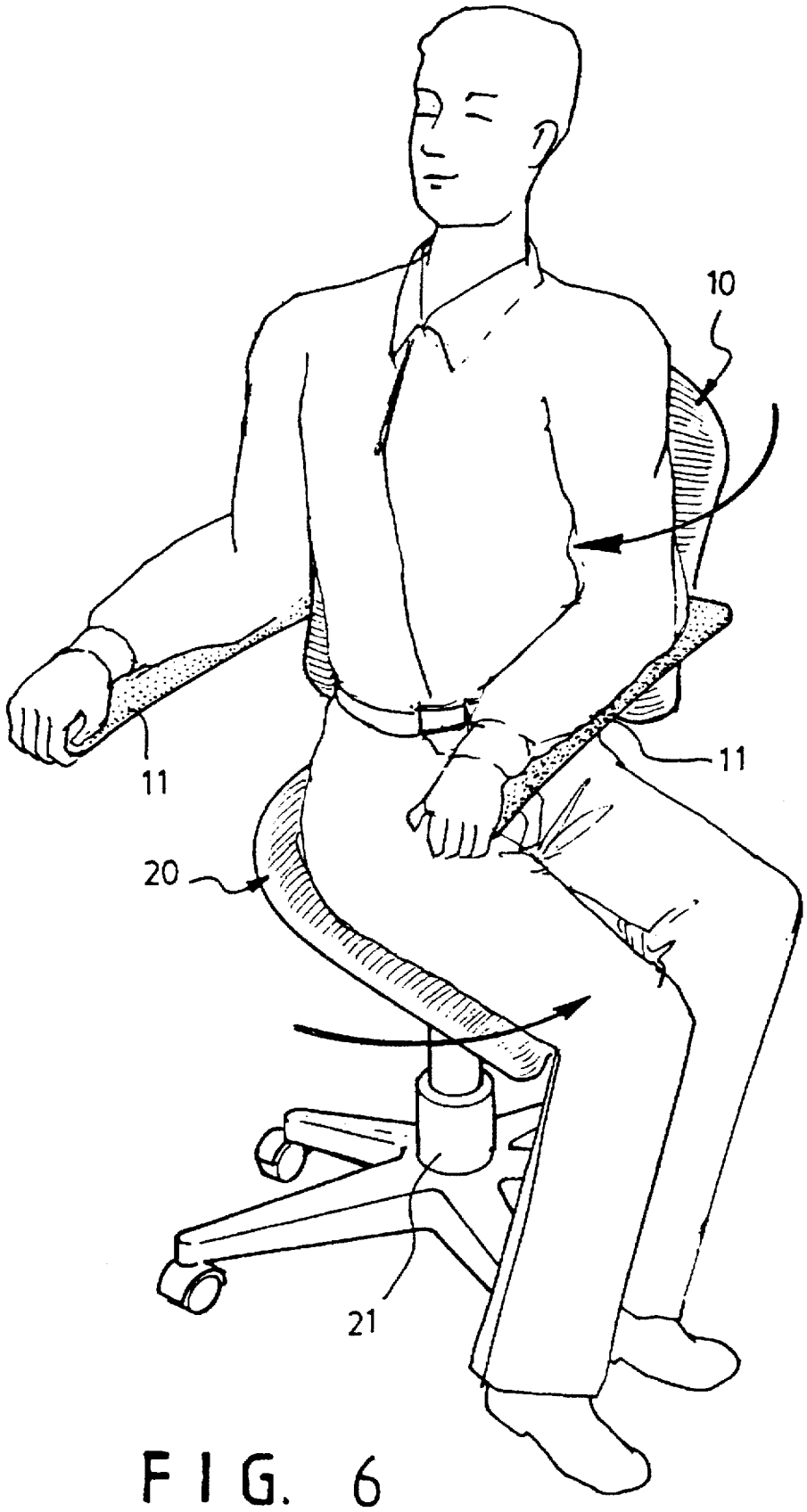
FIG. 6 is a working view of the present invention.

Referring to FIGS. 4 and 6, when a user sitting on the seat 20 puts his arms on the armrest 11 of the chair and twists his lumbar thereby rotating the backrest 10. As the backrest 10 is turned, the vertical shaft 12 and the gear 14 are rotated. Then, the toothed sectorial members 15 and 15' are rotated in opposite directions thus turning the oscillating plate 22 in an opposite direction to the backrest 10 (see FIG. 6).

When desired to increase the torque produced by the gear 14, it is only necessary to increase the diameter of the gear 14 or decrease the diameters of the toothed sectorial members 15 and 15'. Further, the turning amplitude of the backrest 10 can be adjusted by changing the length of the oscillating plate 22 or the toothed sectorial members 15 and 15', Generally, the turning angle between the upper and lower halves of an user preferably lies within 90 degrees and so the turning angle of each of the seat 20 and the backrest 10 should not exceed 45 degrees.

As illustrated in FIG. 3, a locking mechanism 30 is used for controlling the backrest 10. The locking mechanisms 30 includes a control lever having a handle 30 extending out of an opening 130 of the casing 13. The opening 130 is formed with an upper and lower slots for keeping the position of the control lever 30. The control lever is pivotally mounted on a shaft 32 at the intermediate portion. The front portion of the control lever is provided with a stop pin 34 so that when the handle 33 of the control lever is moved downward, the front portion 31 of the control lever will be moved upward thereby positioning the stop pin 34 between the gear 14 and the toothed sectorial member 15' and therefore making the gear 14 impossible to rotate. As a result, the backrest 10 is kept at a fixed position.

Figure 5:
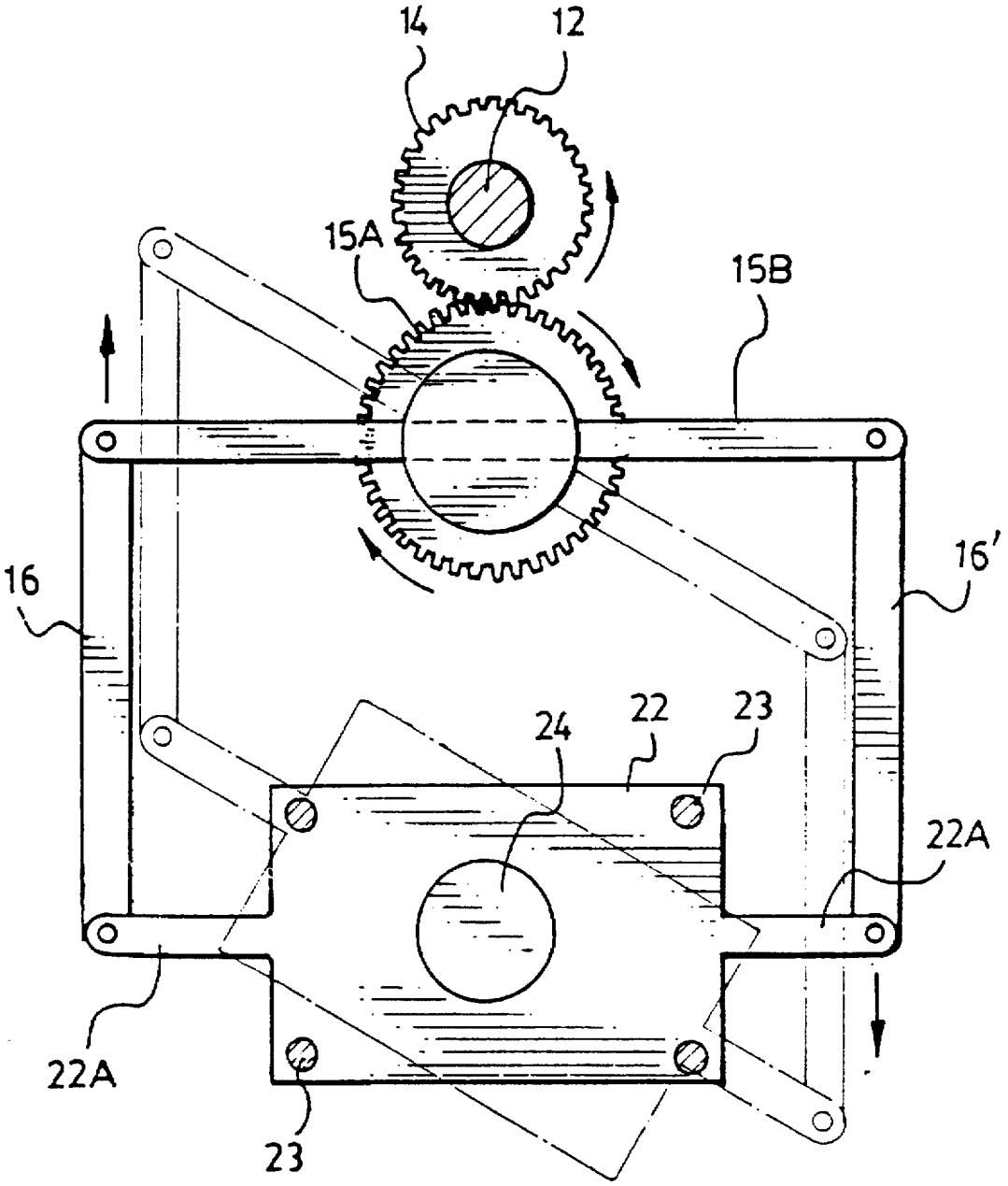
FIG. 5 illustrates a second preferred embodiment of the present invention.

FIG. 5 illustrates a second preferred embodiment of the present invention. As illustrated, the gear 14 is meshed with a gear 15A which is pivotally mounted on a fixed shaft. An elongated rod 15B extends through the fixed shaft and pivotally connected with two linking rods 16 and 16' at its two ends. Two ends 22A of an oscillating plate 22 are pivotally connected with the other ends of the linking rods 16 and 16'.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A chair with a swivel seat and backrest comprising:

a base support having an upright shaft;

a seat having a bottom provided with a supporting board having two opposite bolts, said two opposite bolts being fixedly installed on two opposite ends of an oscillating plate, said oscillating plate having a central portion pivotally connected with a tubular axle, said tubular axle being put on to said upright shaft of said base support;

a backrest;

a casing mounted on said upright shaft of said base support and located under said oscillating plate, said casing being provided with a vertical shaft having an upper portion fixedly engaged with said backrest and a lower end fixedly connected with a first gear;

two linking rods each having an end pivotally connected a respective end of said oscillating plate; and means pivotally connected with said two linking rods and driven by said first gear.

2. The chair with a swivel seat and backrest as claimed in claim 1, wherein said means includes two toothed sectorial members meshed with said first gear.

3. The chair with a swivel seat and backrest as claimed in claim 2, further comprising a locking mechanism having a control lever pivotally mounted within said casing, said control lever having a handle extending out of an opening of said casing, said control lever being provided with a stop pin engageable between said first gear and one of said toothed sectorial members.

4. The chair with a swivel seat and backrest as claimed in claim 3, wherein said opening is formed with an upper slot and a lower slot adapted to receive said control lever.

5. The chair with a swivel backrest as claimed in claim 1, wherein said means includes a second gear meshed with said first gear and pivotally mounted on a fixed shaft, and an elongated rod extending through said fixed shaft and pivotally connected with other ends of said linking rods.

* * * * *